US006668946B2

(12) United States Patent
Rankin et al.

(10) Patent No.: US 6,668,946 B2
(45) Date of Patent: Dec. 30, 2003

(54) BACKREAMER

(75) Inventors: James R. Rankin, Pella, IA (US); Richard K. Smith, Jr., Pella, IA (US); Peter C. Rozendaal, Pella, IA (US); Randy R. Runquist, Oskaloosa, IA (US); Scott A. Rempe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 7 days.

(21) Appl. No.: 10/055,735

(22) Filed: Jan. 22, 2002

(65) Prior Publication Data

US 2002/0096362 A1 Jul. 25, 2002

Related U.S. Application Data

(60) Provisional application No. 60/263,275, filed on Jan. 22, 2001.

(51) Int. Cl.[7] ..... E21B 7/08; E21B 44/00; E21B 47/02

(52) U.S. Cl. ..... 175/62; 175/26; 175/45; 175/53

(58) Field of Search ..... 175/24, 26, 45, 175/53, 62, 73, 74, 76, 79

(56) References Cited

U.S. PATENT DOCUMENTS

| | | | | |
|---|---|---|---|---|
| 3,232,670 | A | 2/1966 | Robbins et al. | |
| 3,234,743 | A | 2/1966 | Levy | |
| 3,354,969 | A | 11/1967 | Ebeling | |
| 3,437,380 | A | 4/1969 | Lawrence | |
| 3,507,342 | A | 4/1970 | Hasewend et al. | |
| 3,734,214 | A | 5/1973 | Benetti et al. | |
| 3,767,836 | A | 10/1973 | Geis et al. | |
| 3,827,512 | A | 8/1974 | Edmond | |
| 3,830,545 | A | 8/1974 | Sugden | |
| 3,851,716 | A | 12/1974 | Barnes | |
| 3,902,563 | A | 9/1975 | Dunn | |
| 3,917,010 | A | 11/1975 | Fink | |
| 3,945,443 | A | 3/1976 | Barnes | |
| 4,024,721 | A | 5/1977 | Takada et al. | |
| 4,117,895 | A | 10/1978 | Ward et al. | |
| 4,280,732 | A | 7/1981 | Haspert | |
| 4,480,942 | A | 11/1984 | Farrow | |
| 4,828,050 | A | 5/1989 | Hashimoto | |
| 4,936,709 | A | 6/1990 | Kimura | |
| 5,014,795 | A | 5/1991 | Gibson | |
| 5,096,002 | A | 3/1992 | Cherrington | |
| 5,176,211 | A | 1/1993 | Halderman et al. | |
| 5,303,783 | A | 4/1994 | Begnaud et al. | |
| 5,427,475 | A | 6/1995 | Coss | |
| 5,461,793 | A | 10/1995 | Melville | |
| 5,505,558 | A | 4/1996 | Brown | |
| 5,813,482 | A | 9/1998 | Barbera | |
| 5,816,345 | A | 10/1998 | Keller | |
| 5,934,391 | A | 8/1999 | Cox | |
| 5,979,574 | A | 11/1999 | Osadchuk | |
| 6,059,051 | A | 5/2000 | Jewkes et al. | |
| 6,289,997 | B1 * | 9/2001 | Bischel et al. | 175/24 |
| 6,315,062 | B1 * | 11/2001 | Alft et al. | 175/45 |

FOREIGN PATENT DOCUMENTS

| | | |
|---|---|---|
| EP | 0 905 347 | 3/1999 |

* cited by examiner

*Primary Examiner*—David Bagnell
*Assistant Examiner*—Brian Halford
(74) *Attorney, Agent, or Firm*—Merchant & Gould PC

(57) ABSTRACT

A steerable reamer and method for use in horizontal directional drilling. The reamer includes a carrier frame rotatably coupled to a reaming body, a carrier frame housing slidably coupled to the carrier frame, and an hydraulic cylinder for tilting the carrier frame relative to the carrier frame housing. The reamer may also include sondes for monitoring the position and orientation of the reamer during operation or a laser guidance system for automatically steering the reamer along a pilot bore.

44 Claims, 12 Drawing Sheets

BACKREAMER

CROSS-REFERENCE TO THE RELATED APPLICATION

This application claims the benefit of U.S. Provisional Application Ser. No. 60/263,275 filed on Jan. 22, 2001.

FIELD OF THE INVENTION

The present invention relates generally to underground drilling machines. More particularly, the present invention relates to reamers for use in horizontal directional drilling.

BACKGROUND OF THE INVENTION

Utility lines for water, electricity, gas, telephone, and cable television are often run underground for reasons of safety and aesthetics. Sometimes, the underground utilities can be buried in a trench that is subsequently back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. The drill string comprises a series of drill pipes threaded together. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. To remove cuttings and dirt during drilling, drilling fluid can be pumped by a pump system through the drill string, over a drill head (e.g., a cutting or boring tool) at the end of the drill string, and back up through the hole. After the drill head reaches a desired depth, the drill head is then directed along a substantially horizontal path to create a horizontal hole. Once the desired length of hole has been drilled, the drill head is then directed upwards to break through the ground surface, completing a pilot bore.

The diameter of the pilot bore so constructed typically must be enlarged. To accomplish this, a reamer (sometimes called a backreamer) is attached to the drill string which is pulled back along the path of the pilot hole, thus reaming out the hole to a larger diameter. The reamer usually includes a reaming or cutting surface on which is mounted cutting teeth or other cutting or grinding elements. It is also common to attach a utility line or other conduit product to the reamer so that the product is pulled through the hole behind the reamer as the reamer enlarges the hole.

A backreamer, then, may perform several functions including: mechanically cutting, grinding and loosening the soil to enlarge the pilot hole diameter, directing drilling fluid to assist in the cutting action, mixing the loosened soil with the drilling fluid such that the resulting slurry is a consistency that will flow out of the bore when displaced by whatever product is to be pulled in, and transferring the longitudinal force required to pull the product through the hole.

The amount of torque necessary to rotate a backreamer depends on several factors which include: the outer diameter of the backreamer, the difference between the diameter of the pilot hole and the outer diameter of the backreamer, the type of soil, the speed at which the backreamer is being rotated, and the longitudinal force being applied to the backreamer.

When utilizing standard backreaming techniques a backreamer is pulled longitudinally along the path of the pilot bore. Under certain conditions, however, the backreamer may tend to deviate from the path defined by the pilot bore. For instance, typically the pilot bore and drill string lie in an arcuate shape. Therefore the longitudinal force being exerted on the drill string tends to straighten the drill string, especially when soil conditions require increased levels of force on the drill string. This straightening tendency can affect the location of the backreamer by pulling the reamer higher. In some jobs the backreamer may move as much as 12 to 18 inches from the pilot bore. Such inaccuracy can have negative effects particularly when a utility or natural obstacle such as a river is being avoided.

In other situations, where large diameter bores are being formed, the weight of the backreamer can cause deviation from the pilot bore. A backreamer is typically moved longitudinally along the pilot bore at a rate in proportion to the drilling fluid being pumped to the reamer and out of the pilot bore. Therefore, longitudinal progress may be very slow. A heavy backreamer in the right soils will tend to drop lower than the pilot bore as it rotates quickly but moves slowly longitudinally.

In still other situations, varying ground conditions can cause the backreamer to move. For instance where there are distinct strata of significantly varying types of soils, the transition zones between one strata and another can cause such a deviation. In another situation there may be random obstacles like relatively large rocks interspersed within soils, that likewise can cause significant deflection of the backreamer.

Deviation from the pilot bore during backreaming is especially problematic in applications where maintaining a desired grade is important. The installation of sewer lines is one such application. The forces exerted on the backreamer by the sewer line being pulled into the bore behind the backreamer as well as the forces exerted by the drill string to cut large diameter holes make it difficult to maintain the desired grade established by the pilot bore. Variations in soil conditions can likewise make it difficult to maintain the desired grade and hole straightness.

SUMMARY OF THE INVENTION

One aspect of the present invention relates to a backreamer adapted with an hydraulic cylinder for steering the reamer as it is pulled or pushed through a pilot bore. The hydraulic cylinder is coupled to both a carrier frame and a carrier frame housing so that by action of the hydraulic cylinder the carrier frame may be tilted relative to the carrier frame housing thereby increasing control and steering during the reaming process.

Another aspect of the present invention relates to a backreamer having an elongated carrier frame housing which operates to make deviation from the pilot bore more difficult. An increased ratio of length to diameter assists the backreamer in following the pilot bore and maintaining a desired grade.

Another aspect of the present invention relates to a backreamer adapted with two sondes for monitoring the position of both ends of the backreamer in order to assist in steering the backreamer by determining the orientation of the backreamer. One sonde is located at a proximal end of the backreamer, and the other sonde is located at a distal end of the backreamer.

Another aspect of the present invention is directed toward a method of backreaming which includes the steps of: providing a backreamer with an hydraulic cylinder which operates to tilt a reaming body or surface of the backreamer relative to a carrier frame housing of the backreamer; running an hydraulic line from a source outside the bore to the hydraulic cylinder; and operating the hydraulic cylinder to assist in steering the backreamer during the reaming process.

Another aspect of the present invention is directed towards a method of backreaming including the steps of providing a backreamer with two sondes, one placed at the proximal and distal ends of the backreamer and using the sondes to monitor the position and angle of the backreamer to assist in steering the backreamer and thereby maintaining a desired course along a pilot bore.

Another aspect of the present invention is directed toward including a laser sensitive guidance system within the backreamer to automatically and accurately guide the backreamer along a desired bore.

Another aspect of the present invention relates to a method for maintaining a desired grade for a backreamer along a pilot bore by guiding the backreamer with a laser beam directed along the desired grade and a laser sensitive target disposed within the backreamer.

Another aspect of the present invention relates to a backreamer adapted with a non-rotating carrier frame and rotating front cutting structure, a controller, a transducer capable of measuring mechanical deflection of the front cutting structure relative to the carrier frame, a steering system capable of directing the front cutting structure, a free motion connection with the product being installed into the ground, and a communication link to the drill rig.

Another aspect of the present invention relates to a backreamer adapted with a non-rotating carrier frame and a rotating cutting structure further adapted such that whenever the formed bore deviates from a straight cylindrical hole there is a measurable deflection of movement within the carrier frame and cutting structure.

Another aspect of the present invention relates to a joint between a carrier frame of a backreamer and a front cutting structure that allows the front cutting structure to shift into an eccentric position relative to the carrier frame such that the cutting structure will advance more aggressively into a direction of the material that is more difficult to cut.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

DETAILED DESCRIPTION

With reference now to the drawings, a description of various exemplary aspects of the present invention will now be provided.

Figure 1:
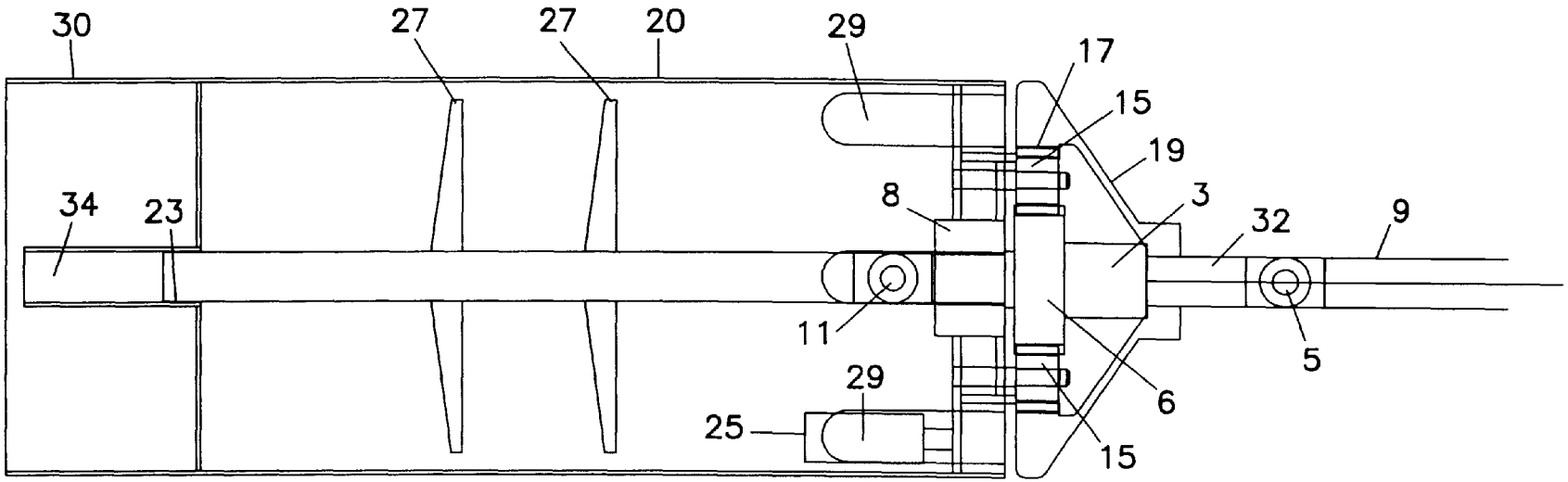
FIG. 1 is an embodiment of a reamer with hydraulic cylinder according to the present invention.

FIG. 1 illustrates a backreamer constructed in accordance with the present invention. This embodiment incorporates features disclosed in U.S. Pat. No. 6,585,062, which is incorporated by reference herein in its entirety. The reamer shown employs a planetary drive system which includes a drive shaft 3, a sun gear 6 disposed on the drive shaft 3, a carrier frame 8 rotatably disposed around the drive shaft 3, planet gears 15 mounted on the carrier frame 8, and a ring gear 17 on which is mounted a reaming surface or reaming body 19. The reaming body or surface 19 grinds and cuts away dirt and stone in order to increase the diameter of the pilot bore.

The drive shaft 3 is configured to be coupled to a drill string 9. The drill string 9 rotates the sun gear 6, which engages the planet gears 15 which in turn rotate the ring gear 17 and, thereby, the reaming body 19. The drill string 9 may be coupled to the drive shaft 3 by means of a u-joint 5 as shown in FIG. 1.

The carrier frame 8 is slidably received by a carrier frame housing 20 so that the carrier frame 8 may be tilted relative to the carrier frame housing 20. The longitudinal force of the drill string pulling the carrier frame 8 is transferred to the carrier frame housing 20 primarily at point 23 where the carrier frame housing 20 is coupled to the drive shaft 3. The drive shaft 3 may be coupled to the carrier frame housing at point 23 by means of thrust bearings, not illustrated herein, as is known in the art.

An hydraulic cylinder 25 is coupled to both the carrier frame housing 20 and the carrier frame 8. The hydraulic cylinder 25 acts to tilt the carrier frame 8 and therefore the reaming body 19 relative to the carrier frame housing 20. Tilting the cutting body 19 relative to the carrier frame housing 20 assists in steering the backreamer and in maintaining a desired bore grade. A second u-joint 11 may be incorporated into the drive shaft 3. U-joints 5 and 11 cooperate to allow flexibility and a greater range of angles at which the carrier frame 8 may be tilted relative to the carrier frame housing 20.

The hydraulic cylinder is configured to be coupled to an hydraulic supply line. The hydraulic supply line may run through the product being pulled into the bore, or may even run between the product and the hole wall.

As shown in FIG. 1, the carrier frame housing 20 may be elongated, increasing the ratio of its length to its diameter. The increased length of the carrier frame housing 20 makes deviation from the pilot bore less likely by preventing the reamer from rising or falling away from the pilot bore. To achieve this effect the length of the carrier frame housing 20 may be made at least as long as its diameter. Preferably the carrier frame housing has a length to diameter ratio greater than 2 to 1 or even greater than 5 to 1.

The present invention may also include a mixing element or elements 27 for mixing drilling fluid with cuttings of stone and dirt to be displaced from the hole. The mixing element 27 may be disposed on the drive shaft 3 and may be shaped as a bar, a blade, a propeller, a rod or any other shape suitable for mixing the slurry. Mixing is more efficient at relatively fast spinning speeds. In the embodiment shown in FIG. 1, the planetary drive train allows the drill string 9 and drive shaft 3 to spin the mixing element 27 at a relatively fast speed to maximize mixing efficiency while the reaming body 19 on the ring gear 17 is spun at a relatively slow speed to maximize cutting efficiency and control. The action of the planetary gear train accomplishes this result. The same drill string powers both the mixing element 27 and the reaming body 19, yet the two rotate at different speeds. For example, the ring gear 17 and the reaming body 19 may rotate at one half or one third the speed of the drill string 9 and the mixing elements 27.

The carrier frame housing 20 may define one or more apertures 29 through which the slurry of drilling fluid and mud enters the carrier frame housing 20. At its distal end 30, the carrier frame housing 20 is configured to be removably coupled to a product line such as a sewer line, utility line, or other conduit or product to be pulled into the hole.

The present invention may also include a sonde or sondes for monitoring the position and orientation of the backreamer. A sonde transmits electronic positioning signals to a worker typically by way of a hand-held complementary receiving device. A first sonde 32 may be positioned near the reaming surface 19 in order to monitor the location of the reaming surface 19. A second sonde 34 may be positioned near the distal end of the carrier frame housing 20. By comparing the location of the first sonde 32 with the location of the second sonde 34, the orientation of the backreamer may be determined. Based on this orientation information, a user is able to monitor the bore grade during the reaming process and is able to adjust the bore grade by steering the reamer. For example a user may steer the reamer with a hydraulic cylinder as is shown in FIG. 1 or any other steering means.

Figure 2:
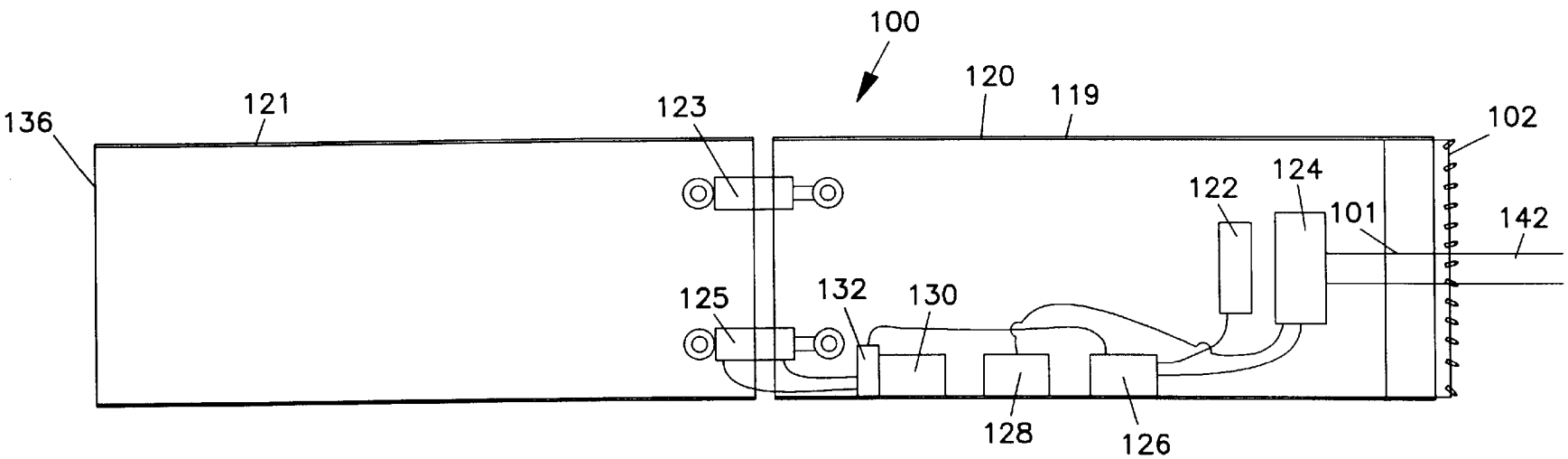
FIG. 2 is a partial schematic view of a backreamer according to the present invention comprising a laser sensitive guidance system.

A backreamer according to the present invention may also be used in conjunction with a laser guidance system in order to maintain a desired grade. FIG. 2 is a backreamer 100 according to the present invention comprising an elongated carrier frame housing 120. The carrier frame housing 120 is comprised of a front body section 119 and a back body section 121. Hydraulic cylinders 123 and 125 couple the front body section 119 and the back body section 121 so that the front and back body sections may be tilted relative to each other.

Inside the carrier frame housing 120 is disposed a laser sensitive target 122 in close proximity to an alternator 124. A controller 126, battery 128, hydraulic pump 130, and valve 132 are also disposed within the carrier frame housing 120. The backreamer carrier frame housing 120 is open at a back end 136 of the back body section 121.

Figure 3:
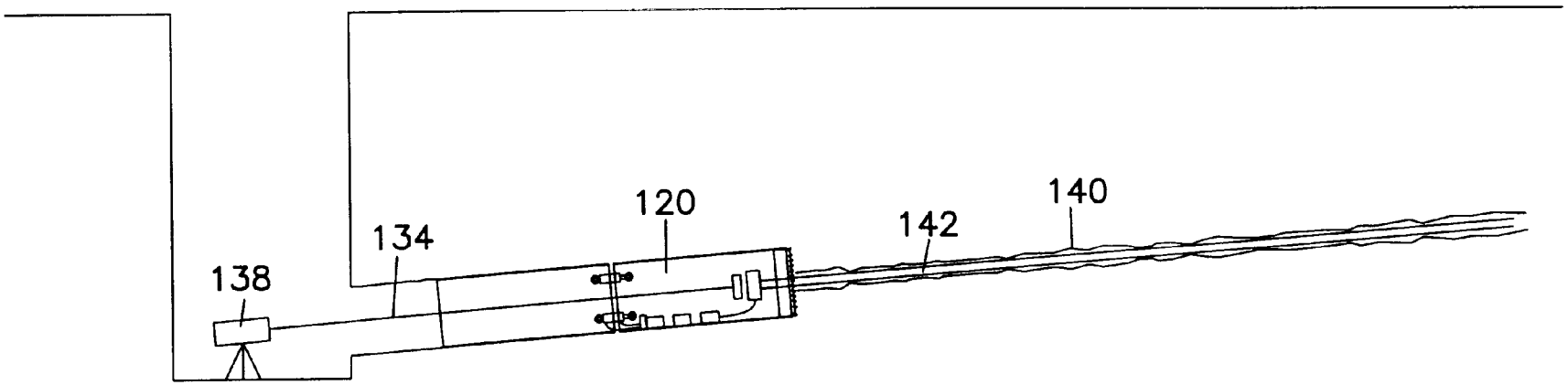
FIG. 3 is a schematic view of the backreamer of FIG. 2 in use according to the present invention.

As shown in FIG. 3 a laser emitter 138 may be placed in a pit at one end of a pilot bore 140. A beam of laser light 134 may be directed through the pilot bore 140 along a desired grade. As the backreamer with carrier frame housing 120 is pulled through the pilot bore 140 along the desired grade, the laser sensitive target 122 detects when the carrier frame housing 120 deviates from the desired grade as established by the laser beam 134. By means of the alternator 124 and the controller 126, the hydraulic cylinders automatically tilt the front body section 119 relative to the back body section 121 in order to steer the backreamer toward the correct grade.

The backreamer 100 may include a planetary drive system or a direct drive system 101 coupling the reaming surface 102 to the drill string 142. The drive system may include a reversing gearbox. Unlike the backreamer depicted in FIG. 1, the backreamer according to FIG. 2 does not require mixing elements. Drilling fluid is directed through the drill string to the reaming surface 102 and then back up the pilot bore.

Figure 4:
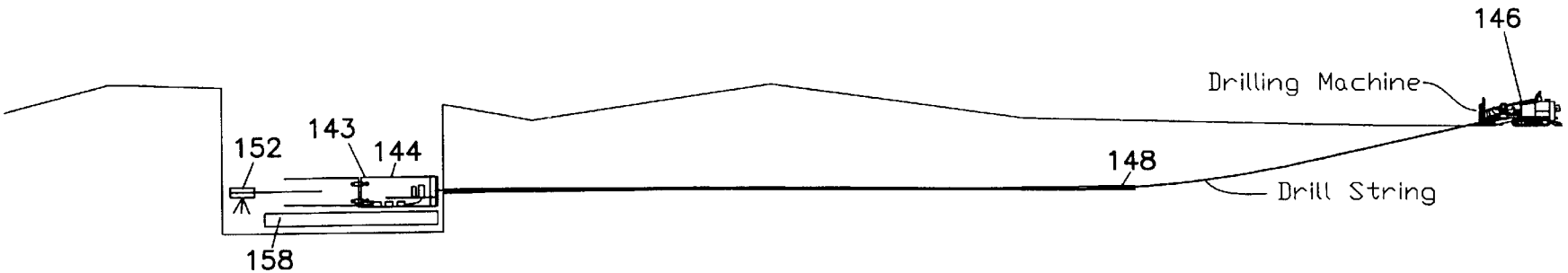
FIG. 4 is a schematic view of a support structure for use in the method of laser guiding a backreamer according to the present invention.

The backreamer may be coupled to a product line to be pulled into the bore while still using the laser guidance technique as long as the product is hollow so that the laser beam 134 is able to pass through the product's center to the backreamer. As shown in FIG. 4, a support structure 158 may be included in the pit to guide the backreamer 143 or product line into the pilot bore 148 in a correct initial orientation 144. Once aligned in a correct initial orientation the backreamer and product line are pulled through the pilot bore 148 by the drilling machine 146 at the ground surface 150 being continuously guided by the laser emitter 152.

Figure 9:
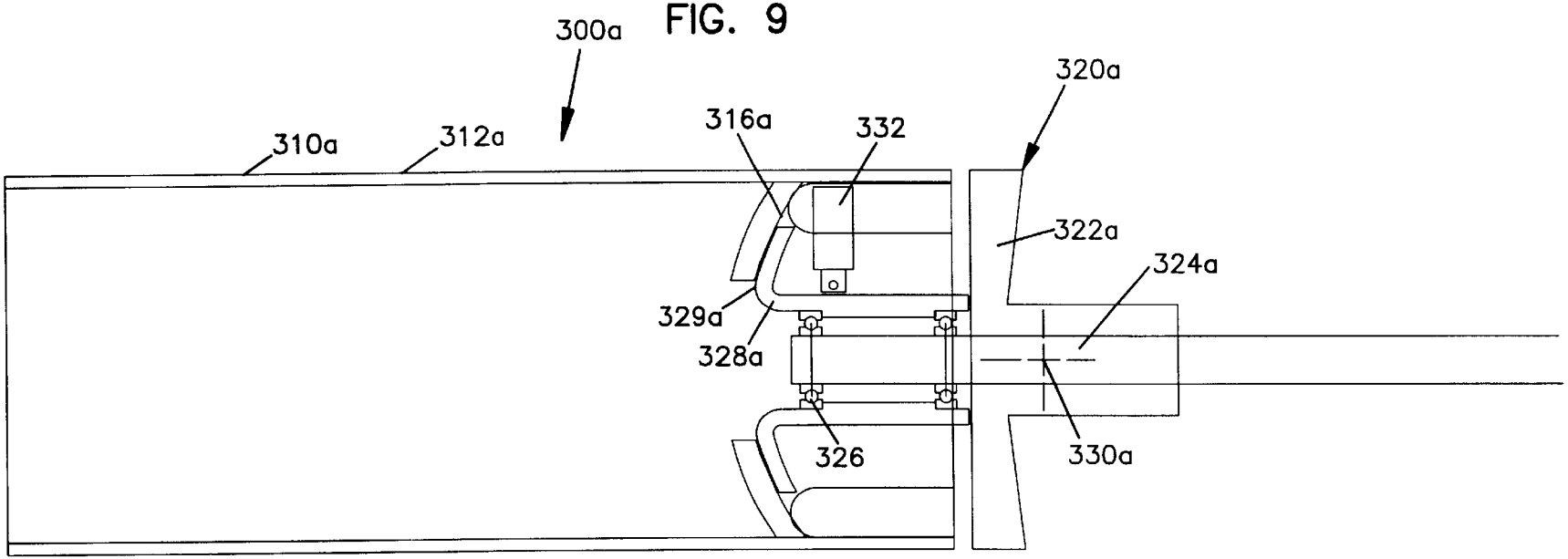
FIG. 9 is a cross section of a second alternative embodiment of a reamer according to the present invention.

An alternative embodiment of a backreamer 300 is illustrated in FIGS. 5, 6, 7, and 8. A second, similar, embodiment is illustrated in FIG. 9 as 300*a*. In the first embodiment the backreamer 300 includes a main housing section 310 and a reamer section 320. The housing 310 is shown in more detail in FIG. 8, and includes an elongated cylindrical section 312 and a support structure 314. The support structure includes a spherical surface 316. The elongated cylindrical section 312 can include slots 318 to allow fluid flow from the outside to the inside of the elongated cylindrical section 312. FIG. 9 illustrates an alternate arrangement of a cylindrical surface 316*a* and an elongated cylindrical section 312*a*.

Figure 7:
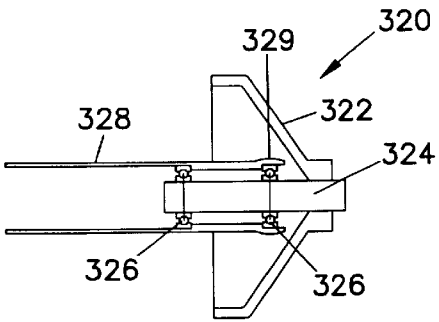
FIG. 7 is a cross section of a reaming portion of the reamer of FIG. 6.

FIG. 7 illustrates the reamer section 320 which includes a reamer 322 that is fixedly attached to a drive shaft 324. The shaft can be constructed from a solid shaft or tube. The shaft 324 is supported on one or more bearings 326 which are installed into frame 328. Frame 328 includes a spherical surface 329. FIG. 9 illustrates an alternate embodiment wherein the shaft 324*a* is supported in frame 328*a* which includes a spherical surface 329*a*.

Figure 6:
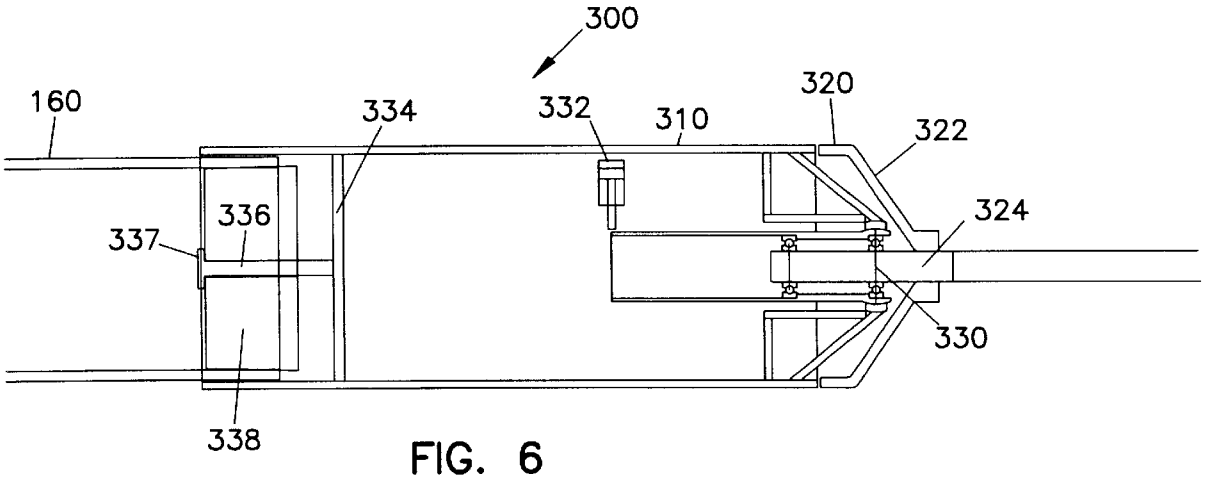
FIG. 6 is a side cross section of the reamer of FIG. 5.
Figure 8:
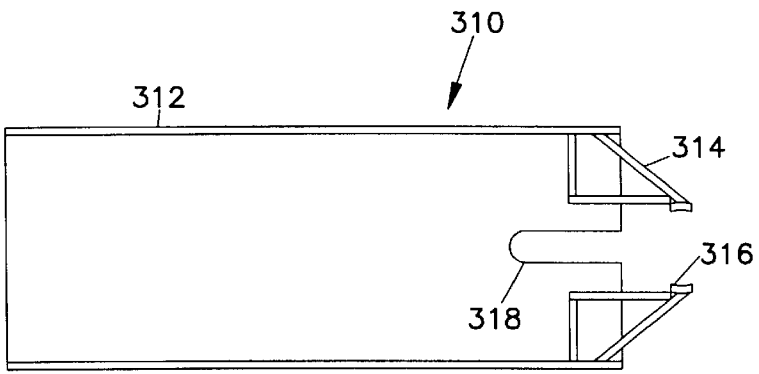
FIG. 8 is a cross section of a housing portion of the reamer of FIG. 6.

Looking again at FIG. 6, the resulting back reamer 300 is assembled with the spherical surface 316 of the supporting structure 314 cooperating with the spherical surface 329 of the frame 328. In this manner the reamer section 320 is able to pivot around point 330, which is the center of the spherical surfaces 316 and 329. Likewise in FIG. 9 this alternate embodiment is designed such that the reamer section 320*a* pivots about point 330*a*. In both of these embodiments points 330 and 330*a* are located outside the main cylindrical section 312 and 312*a* of the housing 310 and 310*a*.

Figure 5:
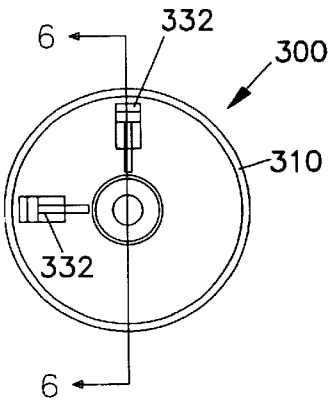
FIG. 5 is a cross section of an alternative embodiment of a reamer according to the present invention.

Looking at FIGS. 5 and 6 the backreamer 300, and in FIG. 9 backreamer 300*a*, further include positioning elements 332. There are 2 such positioning elements located perpendicular to one another, as can be seen in FIG. 5. They are further located at the same longitudinal position along the elongated cylindrical section 312 or 312*a*. The positioning elements are attached on one end to frame 328 and 328*a* and at the other end to the elongated cylindrical housing 312 or 312*a*. Like the hydraulic cylinder 25 in FIG. 1, the length of these positioning elements 332 can be extended or retracted. This variation in length will effectively cause the frame 328 or 328*a* to pivot around point 330 or 330*a* relative to the housing 310. This will have the effect of changing the orientation of the axis of rotation of the shaft 324 and 324*a* relative to the axis of the elongated housing section 312 or 312*a*. The positioning elements 328 may be any of various extendable arms such as hydraulic cylinders, electric actuators, powered screws, pneumatic actuators or the like.

An additional feature of backreamer 300, which could be included for backreamer 300*a* although it is not illustrated, is an element to tow the product 160 being installed. This embodiment utilizes a towing plate 334. This towing plate 334 is fixedly attached to the elongated cylindrical section 312 in a variety of ways. The main requirements include that it can be easily inserted, and then easily removed yet securely fixed in use. The towing plate 334 further includes a tow bar 336 that is adapted to cooperate with a plug 338 such that the tow bar 336 can slide within the plug 338 between a position where an enlarged section 337 of the tow bar 336 contacts the plug 338, as drawn in FIG. 6, and a position where the plug would contact the towing plate 334. With this arrangement the back reamer can move a limited distance without movement of the product, as defined by the difference between the effective length of the tow bar 336 and the width of the plug 338.

Plug 338 is configured as required to connect with the product 160 being installed. This connection will vary greatly, depending on the type of product being installed. The method of connecting the backreamer 300 to the product 160 will include first installing the tow bar 336 and tow plate 334 into plug 338. The plug 334 is then installed into the product 160 and then that joint is secured in any reliable fashion, not a part of this invention. Once that is complete the tow plate is installed into the elongated cylindrical section 312 and secured in place.

Figure 10:
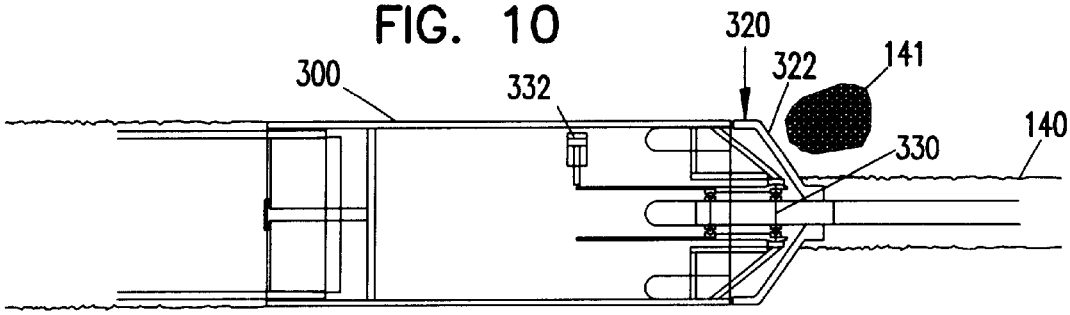
FIG. 10 is a schematic view of a the reamer of FIG. 7 coupled to a product line and disposed within a bore about to encounter a discontinuity in the form of a rock.

The opposite end of the backreamer assembly 300 is then connected to the drill string 142 and the backreaming process begins. As described above for FIG. 4 a support structure 158 may be used to initially guide the backreamer along a straight path. FIGS. 10–17 illustrate one possible scenario wherein this invention is useful. In FIG. 10 a pilot bore 140 has been formed that is close to the desired final location. Backreamer has been started along a straight path. As long as the soil is relatively homogeneous the forces on the reamer 322 will be substantially balanced. The positioning elements 332 will be controlling the orientation of the reamer section 320 so that its axis is aligned with the axis of the housing 310.

If however, a discontinuity such as a rock 141 is encountered, as illustrated in FIG. 10, the forces will become unbalanced and the reamer section 320 will tend to rotate about point 330. This will cause the positioning elements 332 to be affected. There are many types of actuators that could be utilized for the positioning elements 332. In this embodiment they are drawn as hydraulic cylinders.

There are many types of control sequences that could be utilized ranging from load sensing to automated, active control. If load sensing were implemented the relative loads exerted onto the positioning elements could be measured and displayed, as will be described later, such that the drill operator could monitor the progress. If the load becomes unbalanced, slowing the advance rate of the backreamer, and allowing the reamer 322 to more aggressively cut through the soils would tend to bring the load back to a balanced state, and thus to keep the backreamer on a straight bore.

Figure 11:
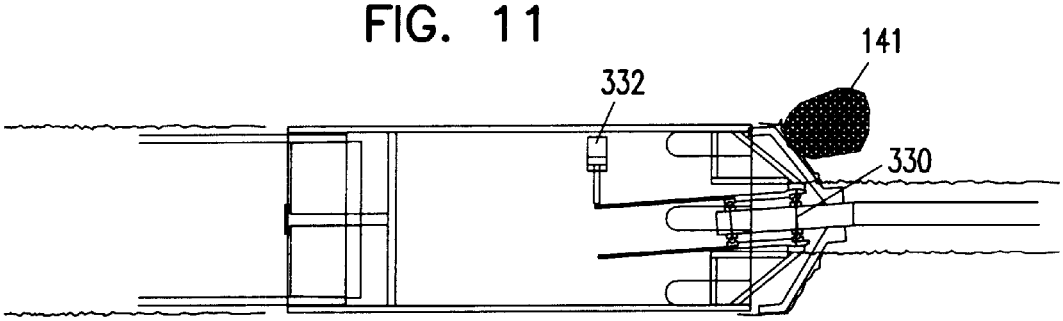
FIG. 11 is schematic view of the reamer of FIG. 10 having struck a rock and having its reaming body pivoted into a tilted position by the rock.

An alternative method is illustrated. In FIG. 11 the backreamer 300 has struck the rock 141, the positioning element 332, a hydraulic cylinder, has allowed the frame 328 to rotate. The aggressiveness of the backreamer can be defined by the pressures at which the cylinder 332 is allowed to extend or retract. Additionally cylinders 332 could include transducers that are capable of measuring their extension such as a Linear Inductive Position Sensor LIPS Series 106 manufactured by Positek Limited. There are many other methods of measuring the location of the frame 328 relative to the elongated cylindrical section 312 of the housing. Once there is sufficient loading and measured travel of one or both cylinders 332 a signal can be generated and sent to the drill operator or the drill as will be explained later.

Figure 12:
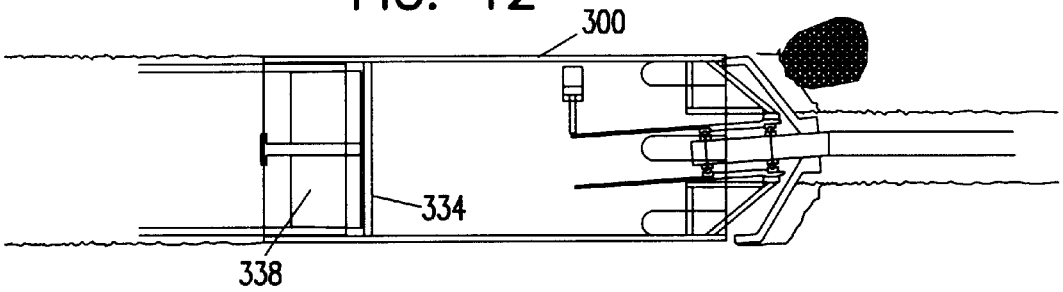
FIG. 12 is a schematic view of the reamer of FIG. 11 after reversing the longitudinal direction of the reamer without reversing the product coupled to the reamer.

FIG. 12 then illustrates the condition where the drill operator has stopped advancement and reversed the backreamer 300 such that the plug 338 is now nearly contacting the towing plate 334. A signal is then generated to inform the drill operator to stop reversing the backreamer.

Figure 13:
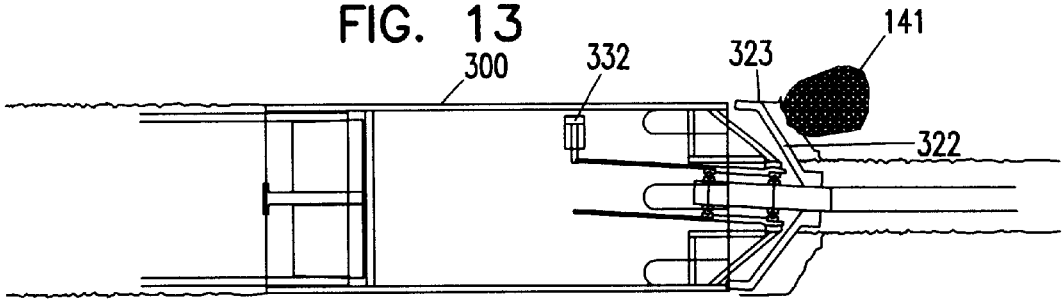
FIG. 13 is a schematic view of the reamer of FIG. 12 with the reaming body tilted into an aggressive cutting position.

In FIG. 13 the cylinder(s) 332 are controlled by a control system with the backreamer, as will be explained below, to compensate for this obstruction, rotating the reamer such that the initial cutting point 323 is advanced in the direction of the obstruction 141.

Figure 14:
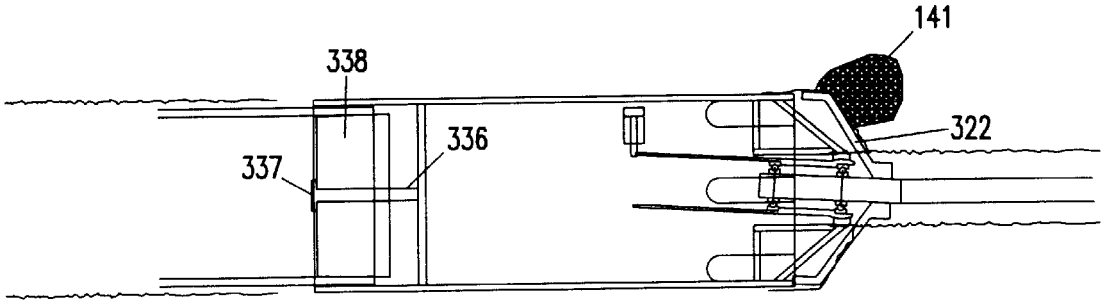
FIG. 14 is a schematic view of the reamer of FIG. 13 being advanced to cut into the rock in the aggressive cutting position.

The drill operator will then be cued to begin advancing the backreamer again and as illustrated in FIG. 14 the reamer 322 cuts into the obstruction 141. The backreamer advances in this manner for a short distance. During this advance monitoring the forces on the two cylinders 332 will not be a true indication of whether the boring is advancing in a straight direction. Thus this advancement is limited to a short distance. As soon as the elongated section 337 of the towing bar 336 contacts the plug 338 a signal is again sent to the operator to stop advancement and reverse direction.

Figure 15:
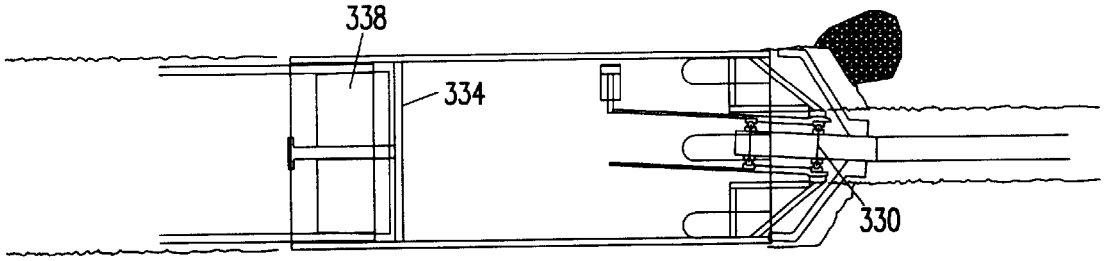
FIG. 15 is a schematic view of the reamer of FIG. 14 after reversing the longitudinal direction of the reamer.

FIG. 15 illustrates the next position wherein the back reamer has been reversed until the plug 338 contacts the towing plate 334.

Figure 16:
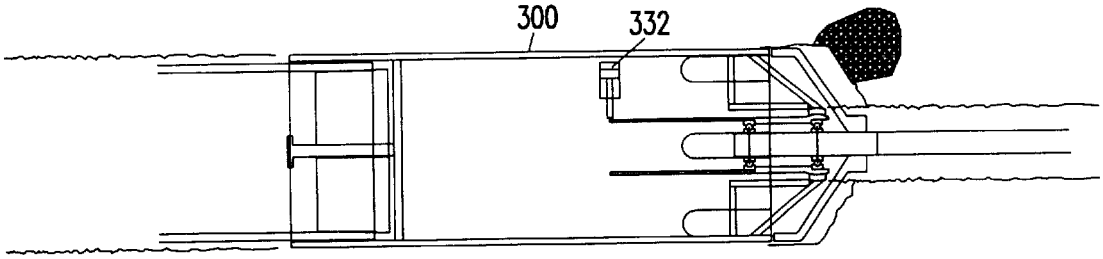
FIG. 16 is a schematic view of the reamer of FIG. 15 after the reaming body is recentered.

At this point the cylinders 332 can be adjusted to bring the axis of the frame 328 back into alignment with the axis of the elongated cylindrical housing section 312 as illustrated in FIG. 16. The operator can then be cued to begin advancement.

Figure 17:
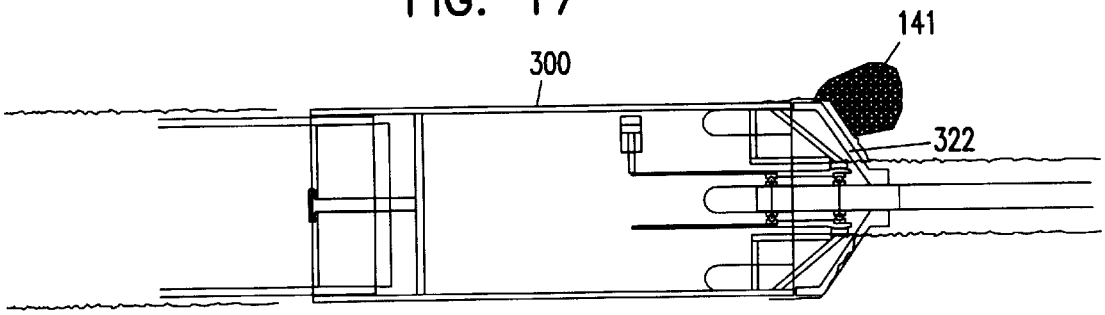
FIG. 17 is a schematic view of the reamer of FIG. 16 advanced while in the recentered position.

FIG. 17 illustrates the advancement of the backreamer wherein the relative forces on the two positioning elements 332 are again being monitored to assess the straightness of the bore.

In the foregoing description it can be seen that an obstacle was encountered, detected, the operator signaled, a correction made, a short correcting boring made, the backreamer reset, and the boring continues. This process will be repeated as frequently as necessary in order to bore a straight borehole.

Figure 18:
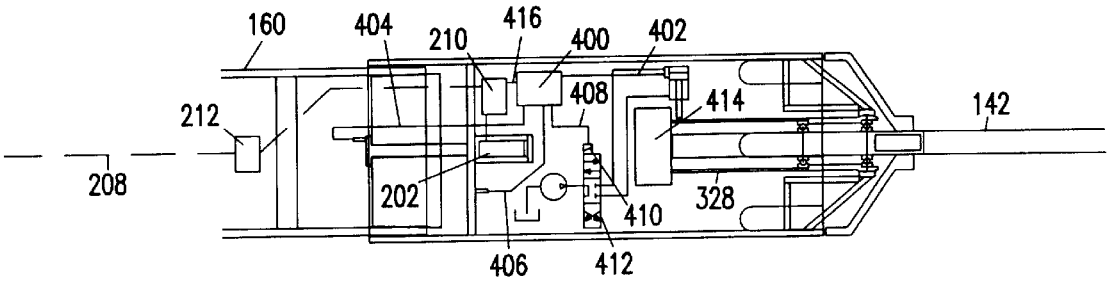
FIG. 18 is a third alternative embodiment of a reamer according to the present invention.
Figure 19:
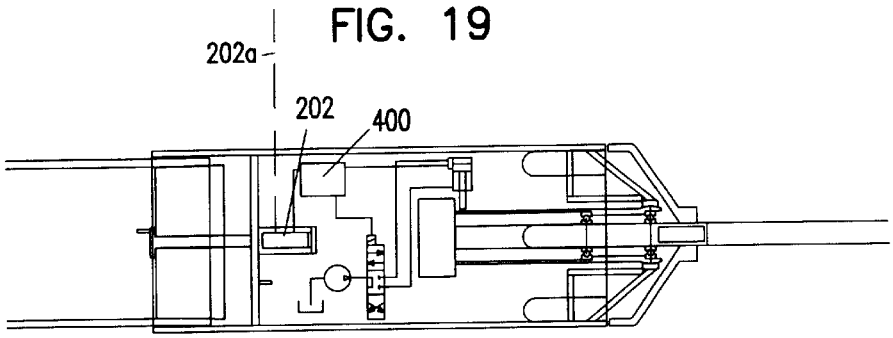
FIG. 19 is a fourth alternative embodiment of a reamer according to the present invention.
Figure 20:
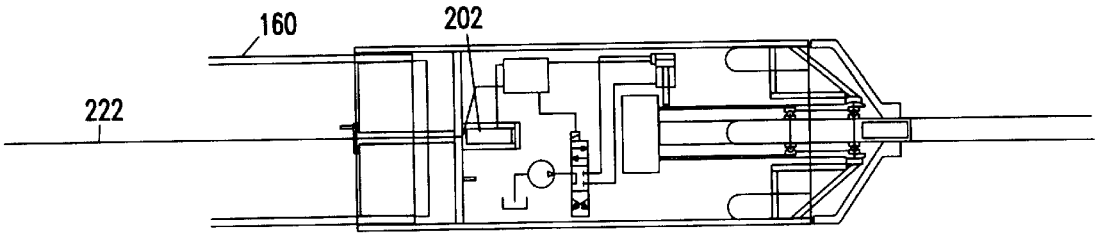
FIG. 20 is a fifth alternative embodiment of a reamer according to the present invention.

FIGS. 18, 19 and 20 illustrate variations of the internal control elements possible with this invention. FIG. 18 illustrates a system wherein a main controller 400 receives input 402 from the positioning elements 332 regarding load and position. It also receives input 404 and 406 from switches 405 and 407 respectively regarding the position of the backreamer relative to the product 160 and subsequently can generate a control signal 408 capable of controlling the positioning element. In the embodiment shown this is an electrical signal to control a solenoid 410 that positions a directional control valve 412 that subsequently controls the hydraulic cylinder 332.

The power for the hydraulic system can come from a variety of sources. In this embodiment there is a hydraulic pump mounted on the housing 328 and driven by main shaft 324, with the drill string 142. Many other alternatives could be implemented.

Figure 21:
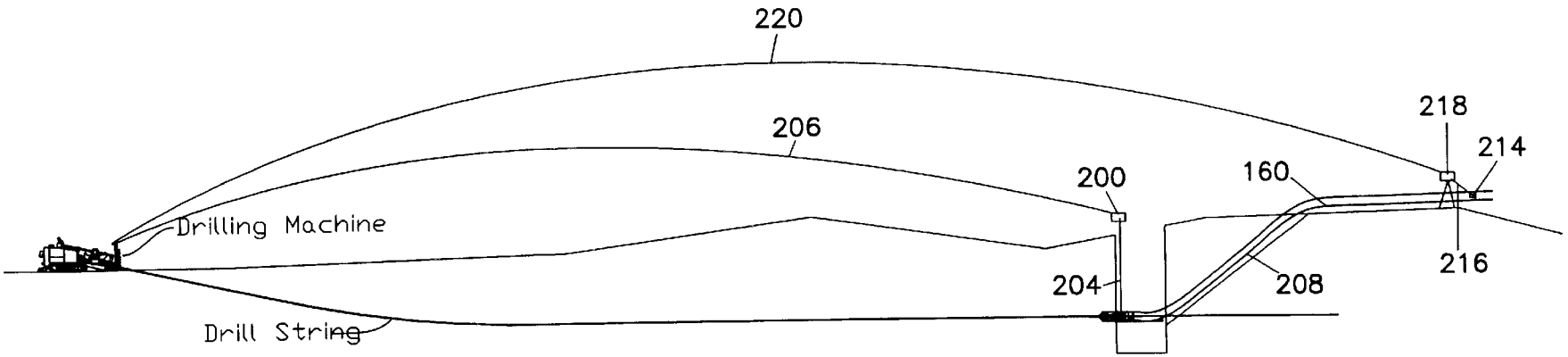
FIG. 21 is schematic view of a backreaming system according to the present invention having a walk-over locator and a receiver/transmitter.

The main controller 400 further generates a control signal 416 that is communicated to a radio transmitter 210 that is capable of communicating with a receiver 212. Receiver 212 further includes an acoustic transmitter that generates an acoustic signal utilized as communication link 208. FIG. 21 further illustrates this communication link 208 terminating at receiver 214. Receiver 214 receives the acoustic signal and generates a radio signal, communication link 216, to receiver 218. Receiver 218 then generates a stronger signal which is communication link 220, back to the drill rig. In this manner the embodiment illustrated in FIG. 18 is capable of communicating to the drill rig.

FIG. 19 illustrates an alternative wherein the main controller 400 communicates to a transmitter 202 that is capable of transmitting a signal to the surface, communication link 204. This signal 202*a* is received by a walk-over locator 200, as is utilized in drilling the pilot bore and is known in the art. The walk-over locator is further capable of producing a signal that is communication link 206 back to the drilling rig.

FIG. 20 illustrates an embodiment wherein a wire or wire bundle 222 is installed into the product 160, and the signal transferred through this wire to the transmitter 218 which can then communicate back to the drill rig via communication link 220. In this embodiment the power necessary to drive the positioning elements may be provided through this wireline.

Each of these 3 embodiments is illustrated with a transmitter 202. This transmitter can be a standard sonde that is capable of also measuring roll position of the backreamer and the inclination angle. In addition to the roll position and inclination measured by the traditional sonde, the tension being applied to the product 160 can be also be measured and transmit to the surface as disclosed in U.S. Pat. Nos. 5,833,015 5,961,252 incorporated herein by reference. An alternate technique for recording this type of information within a data storage device within the backreamer for access after completion of the bore is disclosed in pending, published US S/N 09/794,124 Publication No. US2001/0024597A1 herein incorporated by reference. Any of these techniques can be utilized to provide data in real time for improved machine control or only for limited access to provide verification of a successful installation. Additional parameters such as fluid pressure at the backreamer and temperatures may also be communicated and or recorded. The backreamer of this invention is easily adaptable to any of these additional capabilities.

Figure 22:
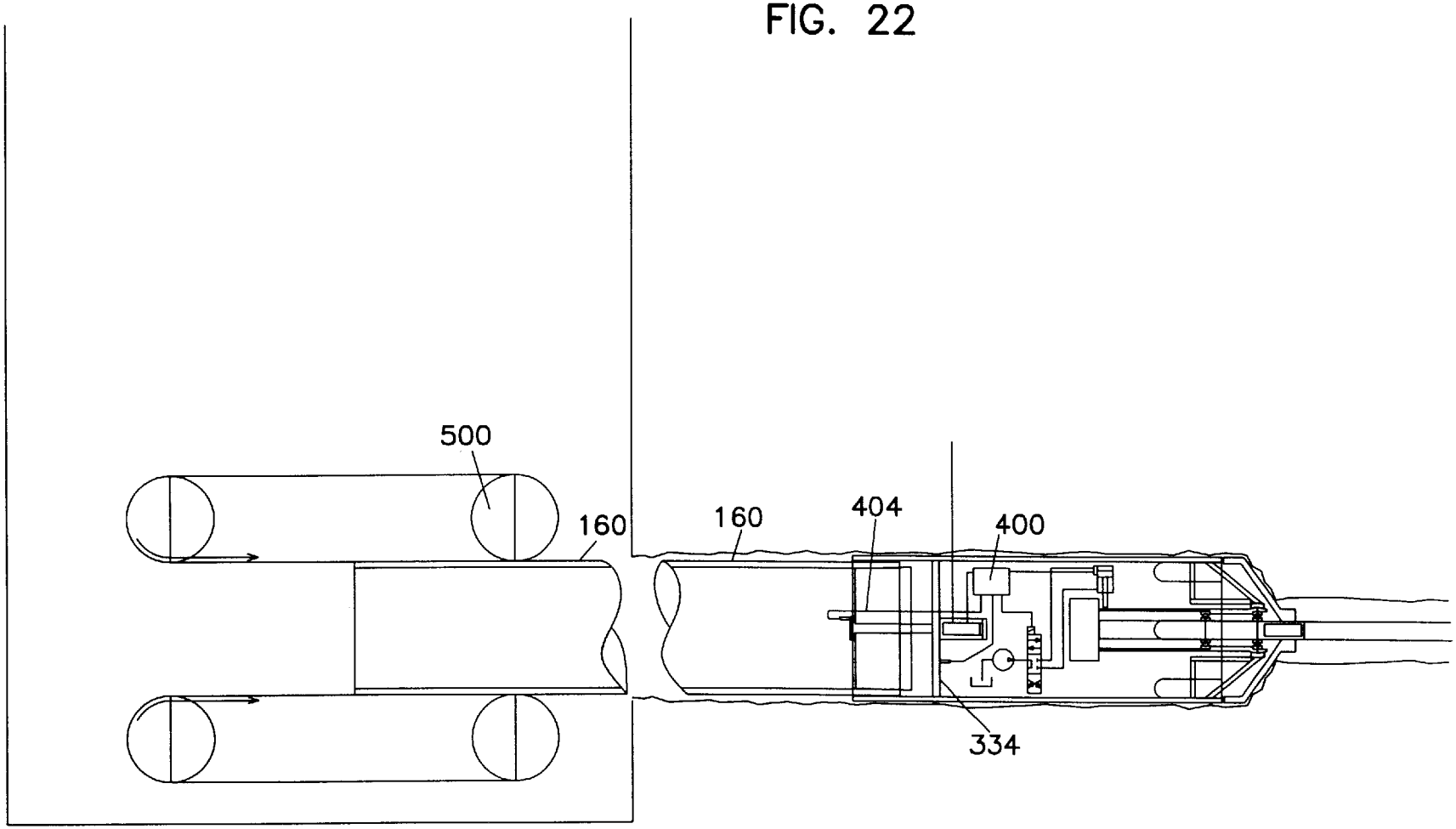
FIG. 22 is an alternative embodiment of a backreaming system according to the present invention including a product driver.

FIG. 22 illustrates an additional improvement related to this invention. A product driver 500 is installed in the pit wherein the product 160 enters the bore hole. This product driver is capable of pushing the product, in conjunction to the backreamer pulling it. The action of the driver 500 needs to be coordinated with the movement of the backreamer. The signal 404 from the sensor 502 mounted to sense when the backreamer is pulling the product 160 can be utilized to generate as signal in a manner to engage the driver 500 whenever the backreamer is pulling the product, but to disengage it whenever it is not. In this manner the one switch is capable of adequately controlling the product driver 500.

Figure 23:
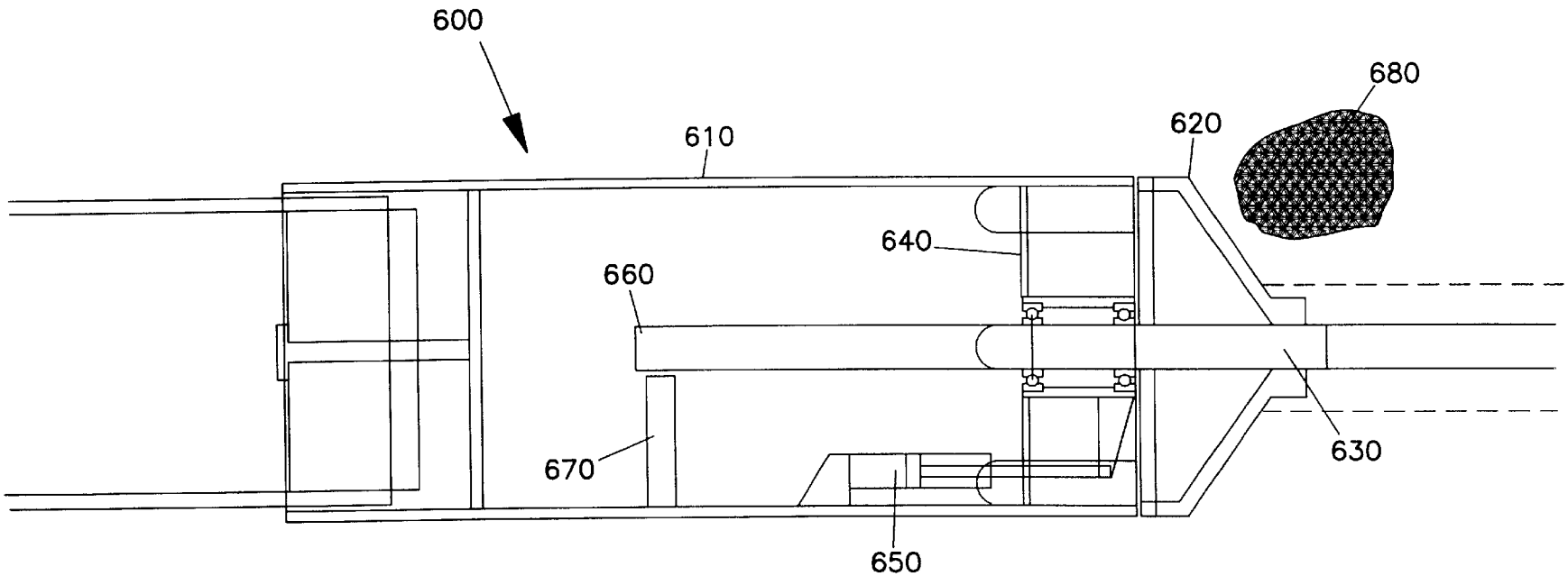
FIG. 23 is an sixth alternative embodiment of a reamer according to the present invention.

FIG. 23 illustrates another aspect of the claimed invention. FIG. 23 shows a backreamer 600 having a housing 610, a reaming body 620, a drive shaft 630, a frame 640, and a cylinder 650 coupled to the housing 610 and the frame 640. Extension member 660 is coupled to the reaming body 620. When the reaming surface impacts obstacle such as rock 680 the reaming body will experience an asymmetrical load which may result in a curved, non-straight bore path. Even in a backreamer which does not include a pivot for tilting the reaming surface relative to the housing, such an asymmetrical load may cause sufficient stress on the backreamer to tilt the reaming body 620 relative to the housing 610. Sensor 670 is designed to detect and measure any such deflection or tilt of the reaming body 620 or drill string relative to the housing 610. In the embodiment shown, extension member 660 remains coaxial with the reaming body 620 when the reaming body 620 experiences the load and deflection caused by rock 680. Extension member 660 is a relatively long shaft. The length of extension member 660 exaggerates the movement of reaming body 620 relative to the housing 610. Sensor 670 may then measure the deflection of extension member 660 relative to the housing 610 in order to detect asymmetrical loads or tilting of the reaming body relative to the housing 610. Cylinder 650 may then be used to counteract the asymmetrical load or to pressure the reaming body 620 toward an aggressive cutting orientation.

The above specification provides a description of the present invention. Since many embodiments of the invention can be made without departing from the spirit and scope of the invention, the invention resides in the claims hereinafter appended.

We claim:

1. A steerable reamer for use in horizontal directional drilling using a drill string, the reamer comprising:

a rotatable drive shaft;

a cutting body having a reaming surface oriented to dig upon rotation of the drive shaft while the reamer is pulled by the drill string;

a frame rotatably coupled to the cutting body;

a housing having proximal and distal ends, the housing being tiltably coupled to the frame; and an extendable arm coupled to both the frame and the housing so that by operation of the extendable arm the frame and thus the cutting body may be tilted relative to the housing.

2. The reamer of claim 1 wherein the housing is configured at its distal end to be removably coupled to a product line.

3. The reamer of claim 2 further comprising mixing elements disposed on the drive shaft.

4. The reamer of claim 3 wherein the housing defines at least one aperture to allow a slurry of drilling fluid, dirt and cuttings to pass into an interior of the housing.

5. The reamer of claim 1 wherein the housing is configured to be of sufficient length so that the ratio of the length of the housing to its diameter is equal to or greater than 1 to 1.

6. The reamer of claim 5 further comprising a front sonde disposed adjacent the proximal end of the housing and a back sonde disposed adjacent the distal end of the housing.

7. The reamer of claim 1 wherein the housing is configured to be of sufficient length so that the ratio of the length of the housing to its diameter is equal to or greater than 2 to 1.

8. The reamer of claim 1 wherein the housing is configured to be of sufficient length so that the ratio of the length of the housing to its diameter is equal to or greater than 5 to 1.

9. The reamer of claim 1 wherein the extendable arm is a hydraulic cylinder.

10. The reamer of claim 1 wherein the housing wherein the housing pivots relative to the frame around a point located outside the proximal end of the housing.

11. The reamer of claim 10 wherein the housing includes an elongated cylindrical portion and wherein the housing pivots relative to the frame around a point located outside the elongated cylindrical portion of the housing.

12. A steerable reamer for use in horizontal directional drilling, the reamer comprising:

a drive shaft having proximal and distal ends;

a front coupling disposed on the proximal end of the drive shaft;

a frame rotatably mounted to the drive shaft;

a sun gear disposed on the drive shaft;

at least one planet gear rotatably mounted to the frame, the planet gear engaging the sun gear;

a ring gear having a reaming surface, the ring gear being rotatably driven by the planet gear;

a housing having proximal and distal ends, the housing being tiltably coupled at its proximal end to the frame; and a hydraulic cylinder coupled to both the frame and the housing so that by operation of the hydraulic cylinder the frame and thus the reaming surface may be tilted relative to the housing.

13. The reamer of claim 12 further comprising mixing elements disposed on the drive shaft.

14. The reamer of claim 13 wherein the housing defines at least one aperture to allow a slurry of drilling fluid, dirt and cuttings to pass into an interior of the housing.

15. The reamer of claim 12 wherein the housing is configured to be of sufficient length so that the ratio of the length of the carrier frame housing to its diameter is greater than or equal to 1 to 1.

16. The reamer of claim 15 further comprising a front sonde disposed adjacent the proximal end of the housing and a back sonde disposed adjacent the distal end of the housing.

17. The reamer of claim 12 wherein the housing is configured to be of sufficient length so that the ratio of the length of the housing to its diameter is greater than or equal to 2 to 1.

18. The reamer of claim 12 wherein the housing is configured to be of sufficient length so that the ratio of the length of the housing to its diameter is greater than or equal to 5 to 1.

19. A steerable reamer for use in horizontal directional drilling, the reamer comprising:

a drive shaft having proximal and distal ends;

a front coupling disposed on the proximal end of the drive shaft;

a frame rotatably mounted to the drive shaft;

a sun gear disposed on the drive shaft;

at least one planet gear rotatably mounted to the frame, the planet gear engaging the sun gear;

a ring gear having a reaming surface, the ring gear being rotatably driven by the planet gear;

a mixing element disposed on the drive shaft;

a housing having proximal and distal ends, the housing being slidably coupled at its proximal end to the frame and configured at its distal end to be removably coupled to a product line, the carrier frame housing defining at least one aperture to allow a slurry of drilling fluid, dirt and cuttings to pass into an interior of the housing;

a hydraulic cylinder coupled to both the frame and the housing so that by operation of the hydraulic cylinder, the frame and thus the reaming surface may be tilted relative to the carrier frame housing;

a front sonde disposed on the drive shaft; and a back sonde disposed in the distal end of the housing.

20. A method for steering a reamer while reaming a pilot bore in horizontal directional drilling, the method including the steps of:

providing a reamer having a frame rotatably coupled to a reaming body, a housing rotatably and pivotally coupled to the frame, and an extendable positioning arm coupled to both the frame and the housing; and pulling the reamer with a drill string while rotating the reaming body so that the reaming body reams along a desired bore; and operating the positioning arm to tilt the frame relative to the housing between a first untilted position and a second tilted position so that when the reamer is advanced while in the first position the reamer tends to form a straight hole and when the reamer is advanced while in the second position the reamer tends to form a curved hole.

21. A method for steering a reamer while reaming a pilot bore in horizontal directional drilling, the method including the steps of:

providing a reamer having a frame rotatably coupled to a reaming body, a housing slidably coupled to the frame, a hydraulic cylinder coupled to both the frame and the housing, a first sonde and a second sonde axially spaced from the first sonde;

pulling the reamer with a drill string while rotating the reaming body so that the reaming body reams along a bore;

monitoring the location of the first and second sondes to determine the position and orientation of the reamer; and operating the hydraulic cylinder to tilt the frame relative to the housing.

22. A backreamer for use in horizontal directional drilling, the backreamer comprising:

a cutting body;

a housing coupled to the cutting body, the housing being of sufficient length so that the ratio of the length of the housing to its diameter is greater than or equal to 1 to 1;

a first sonde located at a distal end of the housing; and a second sonde located at a proximal end of the housing.

23. The backreamer according to claim 22 wherein the ratio of the length of the housing to its diameter is greater than or equal to 2 to 1.

24. The backreamer according to claim 22 wherein the ratio of the length of the housing to its diameter is greater than or equal to 5 to 1.

25. A method of determining a backreamer's position and orientation comprising:

providing a backreamer having a housing, the housing having a proximal end and a distal end, the housing also having a first sonde and a second sonde axially spaced from the first sonde;

receiving electronic signals from the two sondes;

computing the location of both ends of the housing from the electronic signals;

comparing the location of the proximal end to the location of the distal end of housing to determine the orientation of the backreamer.

26. A backreamer for use in horizontal directional drilling, the reamer comprising:

a cutting body configured to be removably coupled to a drill string;

a housing coupled to the cutting body, the housing being of sufficient length so that the ratio of the length of the reamer housing to its diameter is greater than or equal to 1 to 1, the housing having a front section and a back section coupled by a hydraulic cylinder such that the front section may be tilted relative to the back section;

a laser sensitive guidance system disposed inside the housing, the guidance system comprising a target, an alternator, a controller, a battery, a hydraulic pump and a hydraulic valve, wherein the guidance system may automatically reposition the hydraulic cylinder in order to steer the backreamer.

27. A method for steering a backreamer along a desired grade, the method including the steps of:

drilling a pilot bore;

digging a pit at one end of the pilot bore;

placing a laser emitter in the pit and directing a laser beam into the pilot bore along the desired grade;

placing a backreamer into the pilot bore that is capable of automatically detecting deviation from the desired grade by sensing deviation from the laser beam and is capable of automatically adjusting its steering to maintain its position relative to the laser beam;

pulling the backreamer along the pilot bore.

28. A steerable reamer for use in horizontal directional drilling using a drill string, the reamer comprising:

a drive shaft;

a reaming body coupled to the drive shaft, the reaming body having a reaming surface being oriented to ream upon rotation of the drive shaft while the reamer is pulled by the drill string;

a housing rotatably and pivotally coupled to the drive shaft so that the housing may be tilted relative to the reaming body.

29. The steerable reamer of claim 28, further comprising an extendable arm coupled to both the housing and the reaming body which may tilt the housing relative to the reaming body.

30. The steerable reamer of claim 28 further comprising a frame rotatably coupled to the drive shaft, and wherein the housing is pivotally coupled to the drive shaft via the frame.

31. The steerable reamer of claim 30 further comprising a positioning element coupled to the housing and the frame which may tilt the housing relative to the frame.

32. The steerable reamer of claim 31 wherein the positioning element is a hydraulic cylinder.

33. The steerable reamer of claim 30 wherein the housing defines a spherical portion which receives a spherical portion of the frame.

34. A method for steering a backreamer along a desired grade in directional drilling with a drilling machine, the method including the steps of:

drilling a pilot bore;

placing a backreamer having a reaming body and a housing into the pilot bore;

pulling the backreamer along the pilot bore to ream a borehole;

monitoring the orientation of the reaming body relative to the housing;

when a predefined orientation is detected, making a steering correction by tilting the reaming body relative to the housing into a tilted position; and advancing the backreamer in a tilted position.

35. The method of claim 34 wherein the step of monitoring the orientation of the reaming body relative to the housing includes the step of monitoring the load conditions on cylinders used to tilt the housing relative to the reaming body.

36. The method of claim 34 further including the step of longitudinally reversing the backreamer after the predefined orientation is detected and before tilting the reaming body.

37. The method of claim 36 further including the steps of coupling a product line to the backreamer; and pulling the product line into the borehole behind the backreamer.

38. The method of claim 37 further including the step of longitudinally reversing the backreamer without longitudinally reversing the product line after the predefined orientation is detected and before tilting the reaming body.

39. The method of claim 38 further including the step of signaling the drilling machine when the predetermined condition is detected.

40. A backreaming system for use in horizontal directional drilling, the system comprising:

a drilling machine;

a backreamer coupled to the drilling machine by a drill string, the backreamer including a reaming body, a housing, cylinder which positions the cutting body relative to the housing, a detector coupled to the cylinder, and a transmitter;

wherein the detector measures the load experienced by the cylinder and wherein the transmitter transmits a signal to the drilling machine corresponding to the load measured.

41. The backreaming system of claim 40 wherein the signal includes one of a stop signal, a reverse signal, and an advance signal.

42. The backreaming system of claim 40 wherein the drilling machine includes a control system that receives the signal from the transmitter and automatically responds to keep the backreamer boring a straight borehole.

43. A method for detecting deviation of a backreamer from a straight path during horizontal directional drilling, the method including the steps of:

drilling a pilot bore;

placing a backreamer having a reaming body and a housing in the pilot bore, the housing being tiltable relative to a drill string;

pulling the backreamer along the pilot bore with the drill string; and detecting angling of the reaming body relative to the housing.

44. The method of claim 43 wherein the backreamer includes an extension member coupled to and extending from the reaming body, and wherein the step of detecting angling includes measuring the deflection of the extension member relative to the housing.

* * * * *

UNITED STATES PATENT AND TRADEMARK OFFICE

CERTIFICATE OF CORRECTION

PATENT NO. : 6,668,946 B2
DATED : December 30, 2003
INVENTOR(S) : Rankin et al.

It is certified that error appears in the above-identified patent and that said Letters Patent is hereby corrected as shown below:

Column 11,
Line 30, "wherein the housing wherein the housing"
should read -- wherein the housing --.

Column 14,
Line 1, "claim 28, further" should read -- claim 28 further --

Signed and Sealed this

Twenty-ninth Day of June, 2004

JON W. DUDAS
*Acting Director of the United States Patent and Trademark Office*